United States Patent [19]

Zwiener et al.

[11] 4,448,220

[45] May 15, 1984

[54] METHOD FOR OPERATING A TWO-PHASE GRIPPER LOOM AND TWO-PHASE GRIPPER LOOM FOR PERFORMANCE OF THE METHOD

[75] Inventors: Rudolf Zwiener; Anton Lucian; Ernst Gattiker, all of Arbon, Switzerland

[73] Assignee: Aktiengesellschaft Adolph Saurer, Arbon, Switzerland

[21] Appl. No.: 327,624

[22] Filed: Dec. 4, 1981

[30] Foreign Application Priority Data

Dec. 23, 1980 [AT] Austria ..... 6282/80

[51] Int. Cl.[3] ..... D03D 51/02

[52] U.S. Cl. ..... 139/1 E; 139/20; 139/56

[58] Field of Search ..... 139/1 E, 20, 21, 56, 139/156, 328, 435, 436

[56] References Cited

U.S. PATENT DOCUMENTS

| | | | |
|---|---|---|---|
| 2,592,820 | 4/1952 | Moessinger | 139/56 |
| 2,654,397 | 10/1953 | Darash | 139/56 |
| 2,687,148 | 8/1954 | Pfarrwaller | 139/56 |
| 2,956,588 | 10/1960 | Pfarrwaller | 139/56 |
| 3,739,816 | 6/1973 | Kramenic et al. | 139/1 E |

FOREIGN PATENT DOCUMENTS

| | | | |
|---|---|---|---|
| 2701676 | 3/1978 | Fed. Rep. of Germany | 139/1 E |
| 2724872 | 11/1978 | Fed. Rep. of Germany | 139/435 |

*Primary Examiner*—Henry Jaudon

*Attorney, Agent, or Firm*—Werner W. Kleeman

[57] ABSTRACT

The two-phase gripper loom or weaving machine comprises two loom units arranged adjacent one another. Each of their heald frames can be actuated by a heald frame positioning device with a phase shift of 180 angular degrees. Each heald frame positioning device is associated with a related one of the loom units. There is arranged between the common main shaft of the machine and the two rotary shafts of the two heald frame positioning devices a clutch drive for selectively individually connecting or coupling one or the other rotary shaft with the main shaft of the machine or with an auxiliary drive. This enables, during standstill of the machine, to bring the open weaving shed of one or the other loom unit into a closed shed position until the gripper loom is restarted, prior to which restarting the closed weaving shed is brought back again into the open shed position.

10 Claims, 3 Drawing Figures

METHOD FOR OPERATING A TWO-PHASE GRIPPER LOOM AND TWO-PHASE GRIPPER LOOM FOR PERFORMANCE OF THE METHOD

BACKGROUND OF THE INVENTION

The present invention relates to a new and improved method of operating a two-phase gripper loom or weaving machine and to a two-phase gripper loom for the performance of such method.

Generally speaking, the two-phase gripper loom of the present development is of the type comprising two loom units arranged adjacent to one another, wherein each of their heald frames can be actuated in a phase shifted manner by a related one of two heald frame positioning devices. Each heald frame positioning device associated with the related loom unit is provided with heald frame positioning cams and a rotary shaft. Both of these rotary shafts are conjointly driven by the main shaft of the weaving machine or loom.

With such double cloth or two-phase gripper looms the so-called weft thread insertion—also simply weft insertion—occurs alternately, and thus, the periodic shed formation at the one woven fabric web or cloth is performed so as to be offset with respect to the periodic shed formation at the other woven fabric web or cloth by an angle of the crank shaft which, as a rule, amounts to 180°. This means that, following a machine stoppage or shutdown which has been manually triggered or through the agency of a functional supervising or monitoring device, the one loom unit comes to a standstill with its weaving shed closed and the other loom unit with its weaving shed open.

However, with a number of textile materials even a resting period or dwell time of a few minutes with the shed open can lead to such distortions of the warp threads that the fabric produced thereafter only is a reject or, at any rate, a fabric of diminished quality.

SUMMARY OF THE INVENTION

Hence, with the foregoing in mind, it is a primary object of the present invention to provide a new and improved method of operating a two-phase gripper loom and a two-phase gripper loom for the performance of such method, which avoid the aforementioned problems associated with prior art methods and constructions.

Now in order to implement this object and others which will become more readily apparent as the description proceeds, the method according to the present invention contemplates that following the interruption of the weaving process, the one of the two weaving sheds which is still open is closed. Prior to restarting the machine, such closed weaving shed is again opened, so that it is in the same open position as it was prior to the interruption.

The two-phase gripper loom according to the invention is manifested by the features that a clutch or coupling drive is arranged between the main shaft of the weaving machine and the two rotary shafts of the heald frame positioning devices of the two loom units. This clutch drive serves for selectively connecting one or the other rotary shaft with the main shaft of the machine or with an auxiliary drive which, upon standstill of the machine, closes that one of the sheds which is open and again opens the same before the machine restarts.

By virtue of these measures it now is possible to bring the corresponding woven fabric or cloth which is in the open shed position into the condition of the closed shed position during the standstill of the weaving machine, and only to bring back such woven fabric or cloth into the open shed position immediately before restarting the machine.

A suitable embodiment of the two-phase gripper loom according to the invention comprises a machine control, which upon stoppage of the weaving machine disengages a clutch at the loom unit with the open shed. This clutch actuates a positioning element which, by means of the machine control, starts an auxiliary motor, engages an associated cone friction clutch and at the same time blocks further operating functions. In this regard it is advantageous if after attaining the closed shed position, i.e. after a return movement of approximately half a pick, there can be generated by a signal transmitter or generator a cut-off signal for the auxiliary motor. It is then advantageous if upon actuating a cut-on switch or push-button the auxiliary motor is started so as to operate in opposed rotational direction, the related shed is brought back into its previous open position and the blocked operating functions are released through the action of the signal transmitter or the positioning element.

It is advantageous if both rotary shafts can be simultaneously brought into rotational connection with the main shaft of the weaving machine.

In addition it is advantageous if the clutch or coupling drive comprises friction clutches, of which the one clutch part is in rotational connection with a gear element of the auxiliary drive and the other clutch part is in rotational connection with one or the other rotary shaft, as the case may be, and the arrangement is undertaken such that the clutches are cone friction clutches.

A further advantageous construction is manifested by the features that the clutch drive encompasses further clutches, of which one or the other rigidly connects for rotation one or the other related rotary shaft with the main shaft of the weaving machine. As the further clutches there are preferably employed dog or cam clutches which only engage in one position per revolution. The part or element of the dog clutches which is disengageable can be provided with a toothed rim, and the toothed rims mesh with one another and with a gear arranged at the main shaft of the weaving machine.

BRIEF DESCRIPTION OF THE DRAWINGS

The invention will be better understood and objects other than those set forth above will become apparent when consideration is given to the following detailed description thereof. Such description makes reference to the annexed drawings which depict exemplary embodiments of the invention and wherein.

DETAILED DESCRIPTION OF THE PREFERRED EMBODIMENTS

Figure 1:
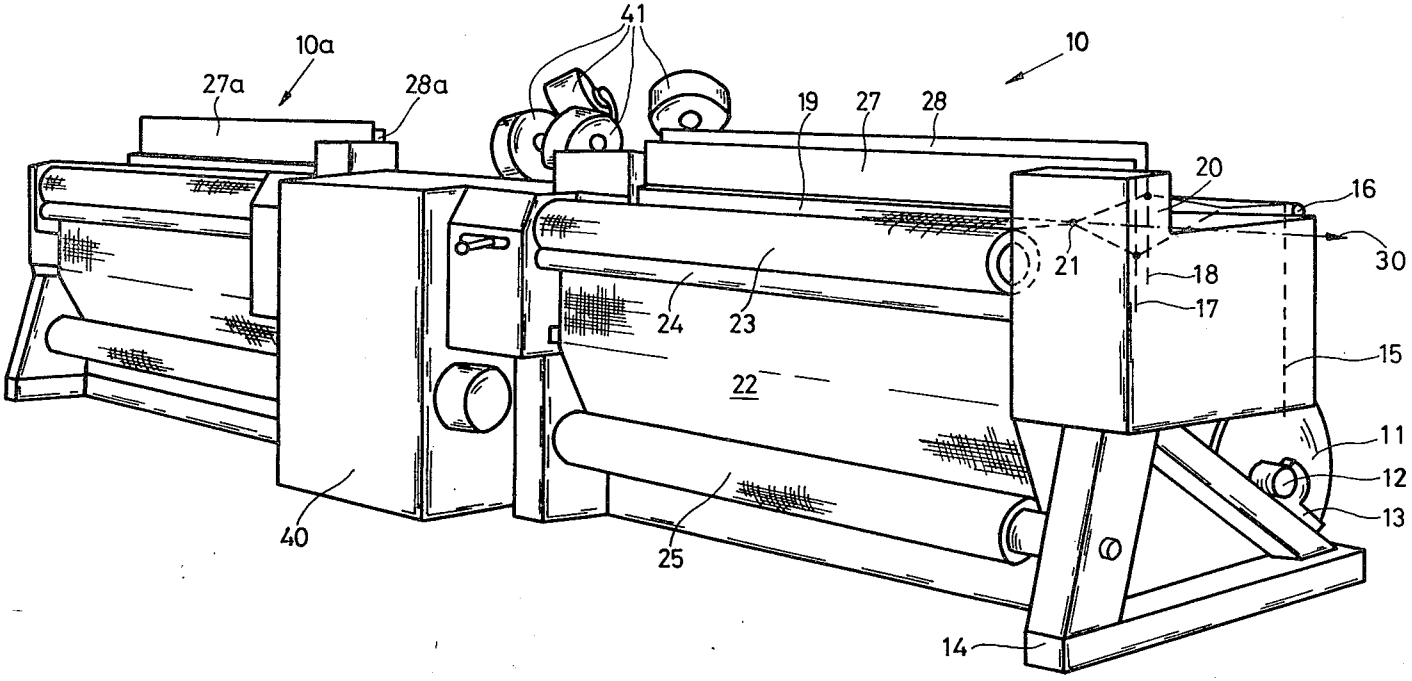
FIG. 1 is a schematic perspective view of a two-phase gripper loom or weaving machine according to the invention.

Describing now the drawings, it is to be understood there has been shown therein only enough of the construction of the two-phase gripper loom as will enable those skilled in the art to readily understand the underlying principles and concepts of the present invention. Thus the two-phase gripper loom or weaving machine shown in schematic perspective view in FIG. 1 will be seen to comprise in known manner two juxtapositioned loom units 10 and 10*a* which essentially have the same construction or design. Arranged between these loom units 10 and 10*a* is a drive and control unit 40. This drive and control unit 40 contains, as is known in the art, among other things, a not particularly illustrated control section, a shed forming apparatus, weft thread infeed devices which are fed with a supply of thread by the weft thread spools 41, and finally, a drive apparatus for the gripper rod or rapier, by means of which the weft threads alternately are inserted into the weaving sheds of the loom units 10 or 10*a*, respectively. Up to this point such construction of two-phase weaving machine may be essentially considered to be conventional, except for details of the shed forming apparatus which will be considered hereinafter in conjunction with FIGS. 2 and 3.

Each loom unit 10 and 10*a* comprises a warp beam 11 which with its shaft 12 is supported to be freely rotatable in a bearing 13 arranged at the machine frame 14. The warp threads 15 which have been withdrawn from the related warp beam 11 are guided in known manner over a tensioning beam 16 and thereafter individually through the heddles or healds 17 or 18 of the heddle or heald frames 27 and 28, respectively. In a manner to be more fully described hereinafter in conjunction with FIGS. 2 and 3, the heald frames 27 and 28 are actuated by the mentioned shed forming apparatus for forming the shed 20. Upon completion of the weft insertion and beating of the weft thread 30 to the fell 21 of the woven fabric or cloth by means of the reed 19, the finished woven fabric or cloth 22 is withdrawn by means of a cloth withdrawal or take-up beam 23 and a deflection beam 24 and rolled up onto a cloth beam 25.

During the here not further described weaving process the so-called weft thread insertion occurs alternately as is well known for such two-phase weaving machines, and thus, the periodic shed formation at the one woven cloth is performed such as to be offset with respect to the periodic shed formation at the other woven cloth by an angle of the crankshaft amounting to 180°.

This means that, following a machine stop which has been induced manually or through the agency of a functional supervising or monitoring device, the one loom unit 10 or 10*a* comes to standstill with its shed closed and the other loom unit 10 or 10*a* with its shed open. As a rule, the loom unit 10 or 10*a* which comes to a standstill with its shed closed is the loom unit 10 or 10*a* where the stoppage or shutdown has been induced as a result of a flaw or malfunction, such as a thread rupture.

FIG. 1 illustrates an operating condition of the two-phase gripper loom, wherein the warp or warp threads of the right-hand loom unit 10 are located in the open shed position, and accordingly, the warp or warp threads of the left-hand loom unit 10*a* are located in the closed shed position.

As initially mentioned, if during a standstill of the weaving machine the woven fabric or cloth remains or dwells in the open shed position, then the warp threads 15 can become distorted. This is to be avoided at all costs.

According to the invention such problem is solved by taking measures which enable closing the weaving shed which, at this time, is open.

Figure 2:
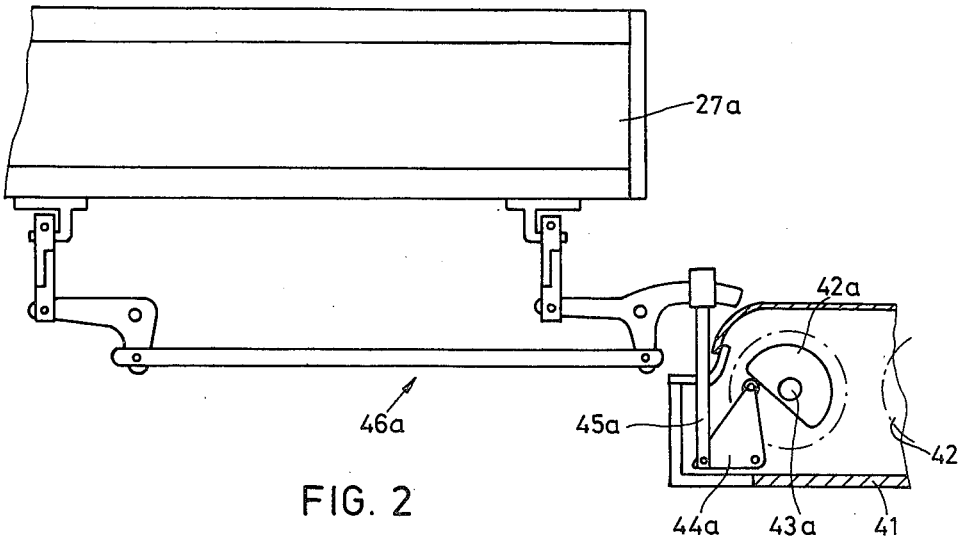
FIG. 2 is a front view and a schematic partial illustration of the shed forming apparatus for a two-phase gripper loom according to FIG. 1.
Figure 3:
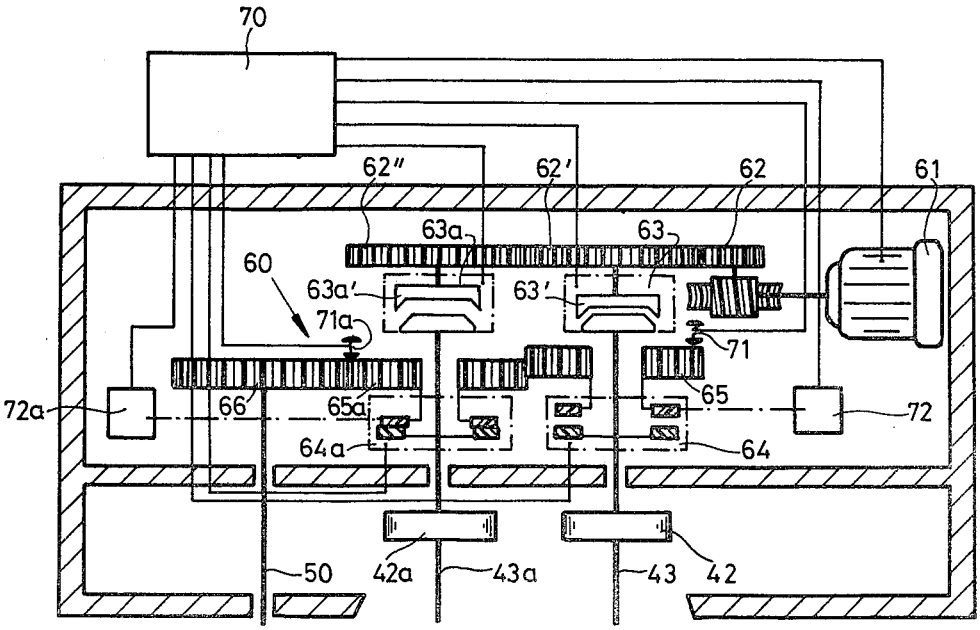
FIG. 3 is a top plan view and a schematic partial illustration of the drive means for the shed forming apparatus according to FIG. 2.

The means for accomplishing these measures essentially have been illustrated in FIGS. 2 and 3, which in schematic and sectional view show the shed forming apparatus contained in control unit 40 (FIG. 1).

The shed forming apparatus, which is illustrated in FIG. 2 in front and schematic view only for the left hand loom unit 10*a* and for a related heald frame 27*a*, comprises a drive housing 41 within which there is mounted a shaft 43*a* equipped with the heald frame positioning cams, the so-called weave connection eccentrics. In order to simplify the illustration, only one of these heald frame positioning cams or weave connection eccentrics has been shown and designated by reference character 42*a*. Likewise, to simplify the illustration, there are not particularly illustrated the known means which allow for exchanging the heald frame positioning cams. The heald frame positioning cam 42*a* acts through a linkage or guide element 44*a* upon a heald frame rod 45*a*. By virtue of the rotation of the heald frame positioning cam 42*a*, this rod 45*a* periodically lifts and lowers the harness or heald frame 27*a*. A corresponding opposed movement is generated at the heald frame 28*a* (FIG. 1) by means of a second, here not illustrated harness positioning cam, analogous to the cam 42*a*, which is mounted upon the same rotational shaft 43*a* as the heald frame positioning cam 42*a*. Thus, the weaving shed 20 is alternately and periodically opened and closed.

For driving the heald frames 27 and 28 of the right-hand loom unit 10 in FIG. 1 there is provided a mirror-image drive arrangement, which only has been generally represented by the heald frame positioning cam 42 in FIG. 2.

At this point it should be mentioned that the remainder of the heald frame drive arrangement can be of any desired and conventional type. Therefore, any further description thereof is unnecessary and has been here omitted, particularly since such is unimportant for understanding the teachings of the present invention.

FIG. 3 is a top plan and schematic view of the drive connection between the machine main shaft 50 and the two rotary shafts 43 and 43*a* of the aforedescribed shed positioning means on both sides. It will be recognized that the machine main shaft 50, of which the drive unit is not further illustrated, is connected for rotation to the two rotary shafts 43 and 43*a* by means of a clutch or coupling drive 60 or equivalent structure. The clutch drive 60 allows selectively connecting one or the other rotary shaft 43 or 43*a* to the machine main shaft 50 or to an auxiliary drive 61, 62 provided with an auxiliary drive motor 61 and a gearing arrangement 62.

Upon standstill of the machine main shaft 50, the auxiliary drive 61, 62 enables rotating one or the other rotary shaft 43 or 43*a* for the purpose of respectively closing or opening the shed in a manner to be described more fully hereinafter. For this purpose there is seated upon the rotary shaft 43 and 43*a* of the heald frame drive of loom unit 10 and 10*a*, respectively, a cone friction clutch 63 and 63*a*, respectively. One clutch part 63′and 63*a*′ of this cone friction clutch 63 and 63*a*, respectively, is connected for rotation to a related gearing element 62′ and 62″, respectively, of the auxiliary drive 61, 62. In the illustration according to FIG. 3 the cone friction clutch or cone clutch 63 is shown engaged, and thus, the auxiliary drive 61, 62 is in rotational connection with the rotary shaft 43 of the heald frame drive of the right-hand loom unit 10. Furthermore, each rotary shaft 43 and 43*a*, is connected to the machine main shaft 50 by means of a dog clutch 64 and 64*a*, respectively, or equivalent connection structure which only engages in one position per revolution. The related disengageable clutch part of the dog clutches 64 and 64*a*, respectively is provided with a toothed rim 65 and 65*a*, respectively. These toothed rims 65 and 65*a* mesh with one another and with a gear 66 mounted upon the machine main shaft 50, as best recognized by referring to FIG. 3.

It is remarked at this point that the aforedescribed clutch or coupling drive, which is arranged between the machine main shaft 50 and the auxiliary drive 61, 62, equally can be of a different design.

Now if the two-phase gripper loom or weaving machine illustrated in FIG. 1 stops, for instance as a result of a thread rupture which has arisen at the left-hand loom unit 10*a*, then the loom comes to a halt in the position illustrated in FIG. 1. In this position the weaving shed of the left-hand loom unit 10*a* properly is closed and the shed of the right-hand loom unit 10 is open.

In order to now bring the weaving shed 20 of the right-hand loom unit 10 equally into the closed position, to keep this shed 20 in its closed position during the standstill of the weaving machine and to bring the closed shed back to its initial open position before restarting the normal operating function of the two-phase gripper loom, the process control is performed such that there is transmitted via machine control 70 a signal to the dog clutch which had its related shed come to a halt in the open position. Thus, in the present example under discussion a signal is transmitted to the dog clutch 64 which is then disengaged as shown in FIG. 3. As a result, the rotary shaft 43 is disengaged from the machine main shaft 50. Together with the disengagement of the dog clutch 64 there is actuated a positioning or setting element 71 which via machine control 70 starts the auxiliary motor 61, actuates or engages the related cone friction clutch 63 and at the same time blocks all further operating functions of the machine, with the exception of the starting function and the so-called weft searching or finding function of the side of the weaving machine which initiated the stop. Thus, the rotary shaft 43 is now in rotational connection with the auxiliary drive 61, 62 and there occurs a shifting of the heald frames 27 and 28 in FIG. 1 in the sense of closing the shed 20 at the right-hand loom unit 10.

After a return movement of approximately half a pick, during which the related shed forming apparatus has arrived at the desired closed shed position, then there is terminated the operation of the auxiliary motor 61 and the related cone friction clutch 63 is disengaged. This is accomplished by means of a positioning or control signal produced by a rotational angle sensor or probe 72.

Independently from the last performed function, the thread rupture now can be repaired at the left-side of the machine, which has initiated the loom stoppage, by arbitrarily actuating the clutches 64*a* and 65*a* of the auxiliary drive 61, 62.

If following the repair of the thread rupture, the two-phase gripper loom is to be restarted, then the relevant shed 20 first has to be brought back into the open shed position.

For this purpose the circuitry preferably is structured such that upon initially depressing not particularly shown cut-on switches at the machine, there is transmitted a further starting signal to the auxiliary motor 61 and to the cone friction clutch 63, whereby the auxiliary motor 61 is caused to rotate in an opposite rotational sense and by means of the rotary shaft 43 opens the related shed 20 and the heald frames. When the shed 20 has reached its open position the dog clutch 64 again engages, whereupon the aforementioned positioning element 71 again, via the machine control 70 stops the auxiliary motor 61, disengages the related cone friction clutch 63 and releases all previously blocked operating functions. Thereupon, a further start pulse properly restarts the two-phase gripper loom.

Thus with the foregoing in mind it will be appreciated that with the method and apparatus according to the invention there can be achieved in a relatively simple manner an intermediate closing of the weaving shed during standstill of the loom or weaving machine.

While there are shown and described preferred embodiments of the present invention, it is to be distinctly understood that the invention is not limited thereto but may be variously embodied and practiced within the scope of the following claims. Accordingly,

What we claim is:

1. In a method of operating a two-phase gripper weaving machine containing two juxtapositioned loom units each having heald frames operated by a heald frame positioning device containing heald frame cam means and respectively movable into open shed and closed shed positions and a respective rotary shaft operatively correlated with each loom unit, the loom units working in phase opposition to one another and the rotary shafts being conjointly driven by a weaving machine main shaft, the improvement which comprises the steps of:

upon interruption of the weaving operation at any one of the loom units closing a still open weaving shed of both sheds of said loom units; and prior to again placing into operation the weaving machine initially again opening the previously closed weaving shed in order to place it back into the open shed position which it possessed prior to interruption in the weaving operation.

2. A two-phase gripper weaving machine comprising:

two juxtapositioned loom units;

each of said loom units having heald frames;

each loom unit having a heald frame positioning device containing heald frame positioning cam means and a rotary shaft;

said loom units being operated in phase-shifted manner with respect to one another;

a weaving machine main shaft for conjointly driving both of said rotary shafts;

clutch drive means arranged between said weaving machine main shaft and both of said rotary shafts of the heald frame positioning devices of both loom units;

an auxiliary drive which upon standstill of the weaving machine closes an open shed at both loom units and prior to restarting of the weaving machine again opens such previously closed open shed; and said clutch drive means serving for the selective individual connection of one or the other rotary shaft with the machine main shaft or with said auxiliary drive.

3. The two-phase gripper weaving machine as defined in claim 2, wherein:

said clutch drive means comprises a respective clutch means provided for each of said loom units;

positioning means operable by said clutch means;

control means cooperating with said positioning means and which upon standstill of the weaving machine serves for disengaging the clutch means associated with the loom unit where its weaving shed is open;

said auxiliary drive comprising an auxiliary motor;

said clutch drive means further including a respective cone clutch provided for each loom unit; and said positioninq means acting upon said control means for placing into operation said auxiliary motor, for engaging a related cone clutch and simultaneously blocking further operating functions of the weaving machine.

4. The two-phase gripper weaving machine as defined in claim 3, further including:

a signal transmitter cooperating with said control means for delivering a cut-off signal to the auxiliary motor upon reaching the closed shed position of the previously open shed.

5. The two-phase gripper weaving machine as defined in claim 4, further including:

means for operating said auxiliary motor to rotate in an opposite rotational sense so that the related shed can be brought back into its previous open position; and at least any one of said signal transmitter or said positioning means releasing the blocked operating functions.

6. The two-phase gripper weaving machine as defined in claim 2, wherein:

said clutch drive means contain structure for simultaneously placing into rotational connection both of the rotary shafts with the machine main shaft.

7. The two-phase gripper weaving machine as defined in claim 2, wherein:

said clutch drive means comprises at least two cone clutches, one for each loom unit;

each of said cone clutches having a first clutch part and a second clutch part;

said auxiliary drive containing gearing elements; and one of the clutch parts of each cone clutch being rigidly connected for rotation with a related gearing element of the auxiliary drive and the other clutch part of each cone clutch being rigidly connected for rotation with a related one of the rotary shafts.

8. The two-phase gripper weaving machine as defined in claim 2, wherein:

said clutch drive means possesses a respective clutch for each loom unit; and each of said clutches respectively connecting a related one of the rotary shafts with the machine main shaft.

9. The two-phase gripper weaving machine as defined in claim 8, wherein:

said clutches comprise dog clutches which only engage in one predetermined position per revolution.

10. The two-phase gripper weaving machine as defined in claim 9, wherein:

each dog clutch contains a disengagable part provided with a toothed rim;

a gear provided for said machine main shaft; and said toothed rims meshing with one another and with said gear of the machine main shaft.

* * * * *